US006914219B2

(12) United States Patent
Kühne

(10) Patent No.: US 6,914,219 B2
(45) Date of Patent: Jul. 5, 2005

(54) OVEN FOR AN AIRCRAFT, HAVING A DC MOTOR DRIVEN FAN

(75) Inventor: Johannes Antonius Maria Kühne, Sleeuwijk (NL)

(73) Assignee: Koninklijke Fabriek Inventum B.V. (NL)

( * ) Notice: Subject to any disclaimer, the term of this patent is extended or adjusted under 35 U.S.C. 154(b) by 0 days.

(21) Appl. No.: 10/746,537

(22) Filed: Dec. 24, 2003

(65) Prior Publication Data

US 2005/0082271 A1 Apr. 21, 2005

(30) Foreign Application Priority Data

Oct. 17, 2003 (NL) ..... 1024564

(51) Int. Cl.[7] ..... A21B 1/26; F24C 7/00; F24C 15/32

(52) U.S. Cl. ..... 219/400; 126/21 A

(58) Field of Search ..... 219/400, 385, 219/386; 126/21 A; 392/360; 310/156.01–177

(56) References Cited

U.S. PATENT DOCUMENTS 3,759,241 A * 9/1973 Berkhoudt ..... 219/400
6,330,152 B1 * 12/2001 Vos et al. ..... 219/400
6,342,262 B1 * 1/2002 Wuest ..... 126/21 A
6,346,691 B2 * 2/2002 Kim et al. ..... 219/400
2002/0014875 A1 2/2002 Durth

FOREIGN PATENT DOCUMENTS

DE 4222092 A1 * 1/1994
EP 0 383 366 A1 2/1987
EP 0 579 074 A1 7/2003
JP 2001128914 A * 12/2000
JP 2001021146 A * 1/2001

OTHER PUBLICATIONS

"Introduction to Hurst Brushless Motors," Beckwith Electronics, Hurst Mfg., web publication printed Feb. 17, 2005, pp. 1–5.*

* cited by examiner

*Primary Examiner*—Joseph Pelham
(74) *Attorney, Agent, or Firm*—Brooks Kushman P.C.

(57) ABSTRACT

The invention relates to an aircraft oven comprising a preparation space and means for heating the content thereof, which heating means comprise a fan driven by a direct-current motor, in particular a brushless direct-current motor, for distributing heat generated by the heating means in the preparation space. The oven can have an electronic control system, wherein electronics for operating the brushless direct-current motor can be integrated into the control system. The direct-current motor can further be thermally insulated relative to the preparation space.

8 Claims, 2 Drawing Sheets

OVEN FOR AN AIRCRAFT, HAVING A DC MOTOR DRIVEN FAN

Figure 1:
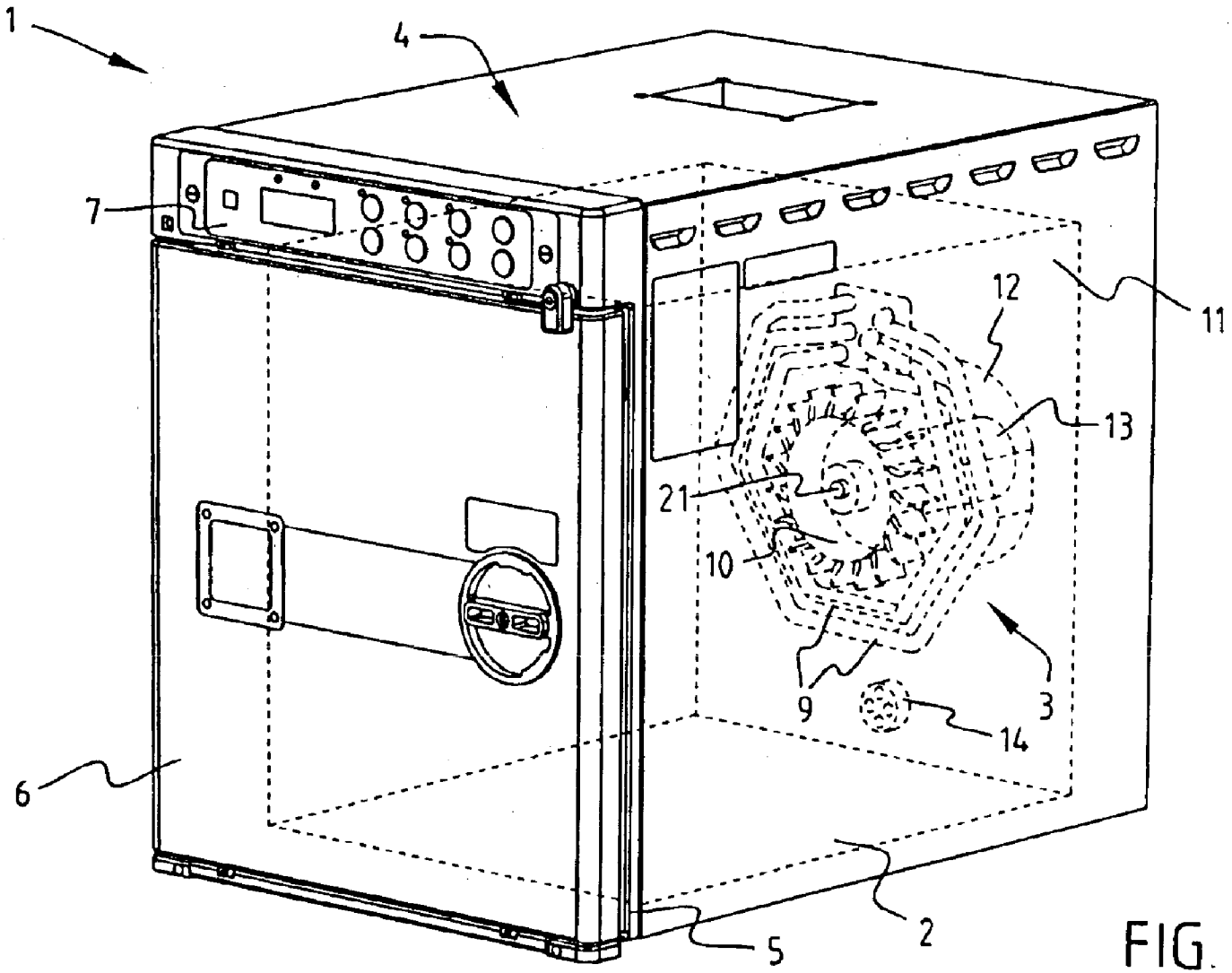

The invention relates to an oven, in particular for application in an aircraft, comprising at least one preparation space and means for heating the content thereof, which heating means comprise at least one fan driven by an electric motor for distributing heat generated by the heating means in the preparation space. Such an aircraft oven is generally known.

Aircraft ovens are powered by the on-board power supply of the aircraft in which they are installed. This onboard power supply produces a three-phase current of 115 V with a frequency of 400 Hz. Fans of conventional aircraft ovens are therefore always driven by alternating current motors, generally asynchronous motors.

The alternating current for the on-board power supply is generated by one or more generators which are each driven rotatingly by a power take-off of an engine of the aircraft. In order to always be able to produce a constant frequency, irrespective of the rotation speed of the aircraft engine, a so-called Constant Speed Drive (CSD) is placed between each generator and engine.

Asynchronous alternating current motors have a number of drawbacks. In the first place they are relatively heavy. In addition, these motors, and in particular the power supply and control circuits thereof, cause electromagnetic interference phenomena (EMI). In order to limit the influence of these phenomena, whereby electronic equipment on board the aircraft can be disrupted, EMI filters must be used, thereby increasing the cost and the weight of the electrical installation.

There is however precisely a trend toward making electrical systems lighter and simpler. Under consideration in this respect is getting rid of the relatively heavy and complicated CSDs and providing, via the on-board power supply, alternating current with a so-called wild or wide frequency which, depending on the rotation speed of the aircraft engine, can vary between 360 and 800 Hz. Modifications of the electric motors of aircraft ovens and their control are necessary in order to still enable proper operation at such variable frequencies.

The invention therefore has for its object to provide an aircraft oven of the type discussed in the preamble, wherein the stated drawbacks do not occur, and which is suitable for use at variable frequencies. This is achieved according to the invention with such an oven in that the electric motor is a direct-current motor. Such a direct-current motor, also referred to as permanent magnet motor, is relatively light and is of course not sensitive to frequency changes.

The direct-current motor is preferably a brushless direct-current motor. Such a brushless motor, wherein the commutation takes place through electronic circuits instead of brushes, is less vulnerable and has a longer lifespan than a motor with brushes. A brushless motor moreover has a more compact and simpler construction, while it furthermore produces no sparking, so that EMI filters can be dispensed with.

In order to protect the electronics necessary for operating the brushless direct-current motor as much as possible from the heat of the oven, when the oven has an electronic control system the electronics are preferably integrated into the control system.

According to a preferred embodiment of the invention, the brushless direct-current motor is free of sensors. By dispensing with the use of sensors, generally Hall sensors which cannot withstand high temperatures very well, the brushless direct-current motor can be integrated into the oven in simple manner. The control of the direct-current motor can then take place on the basis of measured electromagnetic fields. This method of control is known as anti-EMF.

The direct-current motor preferably further comprises a stationary housing carrying a number of windings, inside which housing a core carrying at least one magnet is rotatably mounted. Such an embodiment of the direct-current motor, also known as inner runner, has when compared to a so-called outer runner a direct-current motor wherein the rotating housing carries magnets of plastomer, the advantage being that use can be made for the magnet or magnets of a less temperature-sensitive material.

Because the direct-current motor makes use of a permanent magnet as rotor, and magnets are relatively sensitive to heat, the direct-current motor is preferably also thermally insulated relative to the preparation space. This thermal insulation can be achieved by placing the motor at a distance from the preparation space and/or by insulation material placed between the motor and the preparation space.

Figure 2:
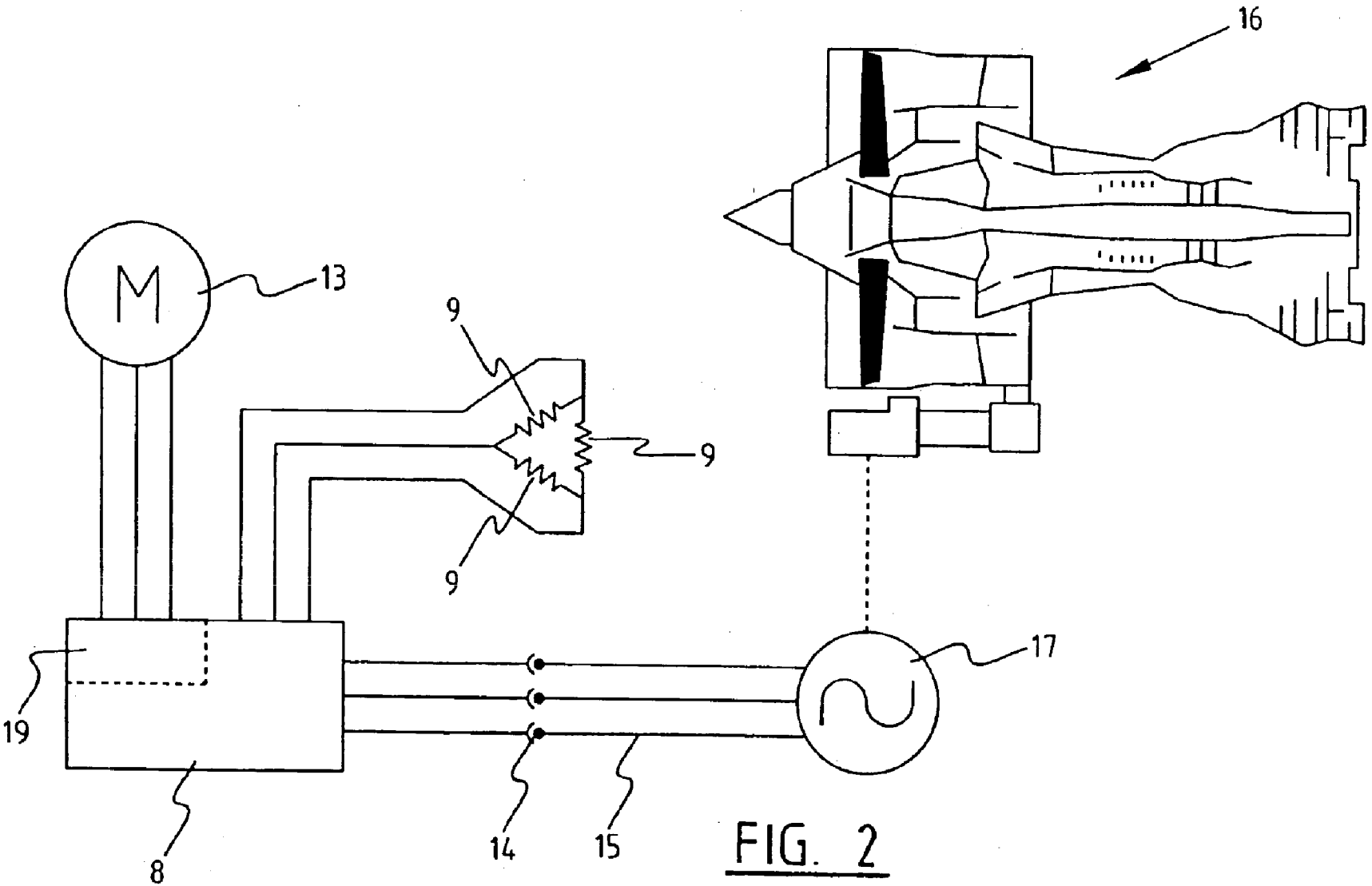

The invention is now elucidated on the basis of an embodiment, wherein reference is made to the annexed drawing, in which:

FIG. 1 is a schematic perspective view of an aircraft oven according to the invention, and FIG. 2 shows an electrical circuit diagram of the oven of FIG. 1 and the connection thereof to an on-board power supply.

An oven 1 (FIG. 1) comprises a space 2 (shown in dotted lines) for preparing food and means 3 for heating the content of preparation space 2. Preparation space 2 and heating means 3 are accommodated in a housing 4 which has at the front an opening 5 which is closed by a door 6. Also formed on the front of oven 1 is a control panel 7 which is connected to a control system 8 of oven 1 to be discussed hereinbelow.

In the shown embodiment the oven 1 is embodied as hot air or convection oven. Heating means 3 therefore comprise one or more heating elements 9, in the shown embodiment electrical resistance elements, which generate heat when an electric current runs therethrough. In addition, the heating means comprise a fan 10 which is driven by an electric motor 13 via a shaft 21 so as to bring about an air circulation in preparation space 2, whereby the generated heat is distributed and carried to the food for preparing.

Heating elements 9 extend along the inner side of an end wall 11 of preparation space 2, on which the fan 10 is also mounted. Electric motor 13 of fan 10 is on the other hand accommodated in a housing 12 fixed to the outside of this end wall 11. Heating elements 9 are powered with electric current via connections 14 which protrude through end wall 11 and which are connected to an electrical power supply 15 in the space where oven 1 is placed, in the shown embodiment the on-board power supply of an aircraft. Electric motor 13 of fan 10 is also powered by the on-board power supply 15.

The operation of heating elements 9 and fan 10 is further controlled by control system 8, which is formed here by a board with electronic circuits placed above preparation space 2. Control system 8 is connected between electrical power supply 15 and the different components of heating means 3.

As is usual, the on-board power supply 15 is a three-phase current system with a voltage of 115 V. The alternating current is generated by a generator 17 which is driven by a (schematically shown) engine 16 of the aircraft. Due to the absence of a CSD the frequency of the alternating current will vary between values of about 360 and 800 Hz, depending on the rotation speed of the aircraft engine 16.

In order to be able to function properly at such so-called wild or wide frequencies, the electric motor 13 of fan 10 is embodied according to the present invention as direct-current motor or permanent magnet motor instead of as asynchronous motor as is usual with ovens of the type. Such a direct-current motor is after all insensitive to variations in the frequency of the alternating current. In the shown embodiment a brushless direct-current motor has been chosen, wherein the switching between the different stator coils is achieved using control electronics 19. These control electronics 19 on the one hand convert the presented alternating current with variable frequency into a current which direct-current motor 13 can use, and on the other hand control energizing of the stator coils on the basis of information on the position of the rotor. In order to protect the control electronics 19, which are sensitive to heat, as much as possible from the influence of the high temperature in preparation space 2, they can be at least partly integrated into control system 8.

It is not only the control electronics 19 which are sensitive to high temperature, so too is the rotor of direct-current motor 13, which carries one or more magnets or is manufactured wholly from magnetic material. In the shown embodiment a so-called inner runner has therefore been chosen, wherein the rotor forms the core and the stator coils are arranged on a stationary housing. Use can hereby be made for the rotor of conventional magnetic material which can better withstand heat than the plastomer used in the magnets of a so-called outer runner. More exotic materials, which have an even better heat resistance but which are also much more expensive, can also be applied instead of conventional magnetic material.

In order to also protect the rotor from the heat from preparation space 2, the direct-current motor 13 is further placed as far as possible outside preparation space 2. This can be achieved for instance by making use of a relatively long shaft 21 between motor 13 and fan 10. In addition, a layer of insulating material (not shown here) can be arranged between direct-current motor 13 and end wall 11 of preparation space 2.

In this manner the brushless direct-current motor 13 can thus be applied for driving the fan 10 of oven 1, despite the high temperatures prevailing therein. Oven 1 can thus be connected to an electrical power supply which supplies alternating current with a variable frequency. By making use of a direct-current motor weight and space are moreover saved when compared to an asynchronous motor, while the use of EMI filters can furthermore be dispensed with when a brushless direct-current motor is used.

Although the invention is elucidated above on the basis of one embodiment, it will be apparent that it is not limited thereto. Instead of a convection oven, a steam oven could thus also be equipped with the direct-current motor according to the invention. The oven could also be connected to a conventional on-board power supply with a constant frequency of 400 Hz. A direct-current motor with brushes could further be applied while retaining some of the advantages. The scope of the invention is therefore defined solely by the following claims.

What is claimed is:

1. An oven for use in an aircraft, comprising:

at least one preparation space;

a heating element for heating the content of the preparation space;

at least one fan driven by an electric motor for circulating air within the preparation space to distribute the heat generated by the heating element, characterized in that the electric motor is a brushless direct-current permanent motor which is free of sensors.

2. Oven as claimed in claim 1, characterized in that the direct-current motor is thermally insulated relative to the preparation space.

3. Oven as claimed in claim 2, characterized in that the thermal insulation is achieved by placing the motor at a distance from the preparation space.

4. Oven as claims in claim 2 characterized in that the thermal insulation is achieved by insulation material placed between the motor and the preparation space.

5. The oven of claim 1 further comprising an anti-EMF motor controller.

6. The oven of claim 5 further comprising an electronic oven control system regulating the heating element, wherein the anti-EMF motor controller is at least partially integrated into the electronic oven control system.

7. The oven of claim 1 wherein the electric motor is provided with a stationary housing having a stator coil, and a rotary core having at least one permanent magnet.

8. The oven of claim 7 wherein the permanent magnet does not include a plastomer.

* * * * *